United States Patent [19]

Bearden, Jr. et al.

[11] 4,094,765

[45] June 13, 1978

[54] COAL LIQUEFACTION PROCESS

[75] Inventors: Roby Bearden, Jr.; Clyde L. Aldridge, both of Baton Rouge, La.

[73] Assignee: Exxon Research & Engineering Co., Linden, N.J.

[21] Appl. No.: 751,385

[22] Filed: Dec. 17, 1976

[51] Int. Cl.[2] ..... C10G 1/06
[52] U.S. Cl. ..... 208/8
[58] Field of Search ..... 208/8, 10

[56] References Cited

U.S. PATENT DOCUMENTS

| | | | |
|---|---|---|---|
| 1,950,333 | 3/1934 | Szeszich | 208/10 |
| 3,503,863 | 3/1970 | Gatsis | 208/8 |
| 3,976,557 | 8/1976 | Shen et al. | 208/10 |

*Primary Examiner*—Delbert E. Gantz
*Assistant Examiner*—James W. Hellwege
*Attorney, Agent, or Firm*—Marthe L. Gibbons

[57] ABSTRACT

A coal liquefaction chargestock is first treated with a hydrogen sulfide-containing gas and thereafter subjected to coal liquefaction conditions.

18 Claims, No Drawings

COAL LIQUEFACTION PROCESS

BACKGROUND OF THE INVENTION

1. Field of the Invention

The present invention relates to an improved coal liquefaction process. More particularly, the invention relates to a process comprising pretreatment of a coal liquefaction chargestock followed by coal liquefaction.

2. Description of the Prior Art

Coal liquefaction processes in which coal with or without a diluent is subjected to elevated temperatures and pressures to convert the coal to normally liquid hydrocarbonaceous products are well known. Coal liquefaction processes in which coal is converted in the presence of a hydrogen donor diluent with or without added hydrogen are also known. See for example U.S. Pat. No. 3,645,885 and U.S. Pat. No. 3,617,513, the teachings of which are hereby incorporated by reference.

U.S. Pat. No. 3,303,126 discloses a non-catalytic hydrorefining process for hydrocarbonaceous oils in which a mixture of hydrogen and hydrogen sulfide is utilized.

U.S. Pat. No. 3,271,302 discloses pretreatment of a hydrocarbon oil feed with hydrogen and hydrogen sulfide followed by catalytic hydrorefining.

U.S. Pat. No. 3,503,863 discloses the addition of hydrogen sulfide to a hydrogen donor solvent coal liquefaction process.

It has now been found that pretreatment of the coal liquefaction feed with a hydrogen sulfide-containing gas gives improved coal liquefaction results such as, coke suppression and an increase of liquid yield.

SUMMARY OF THE INVENTION

In accordance with the invention, there is provided a process for the liquefaction of coal, which comprises the steps of: (a) treating a slurry comprising coal and a diluent with a hydrogen sulfide-containing gas, and (b) subjecting at least a portion of the resulting product effluent to coal liquefaction conditions in a coal liquefaction zone.

DESCRIPTION OF THE PREFERRED EMBODIMENTS

The process of the present invention is generally applicable to treating a slurry comprising coal and a diluent. The term "coal" is used herein to designate a normally solid carbonaceous material including all ranks of coal, such as anthracite coal, bituminous coal, semibituminous coal, subbituminous coal, lignite, peat, and mixtures thereof.

Diluents useful in the practice of the present invention, defined in terms of hydrogen donor potential are (1) hydrogen donor diluents which contain at least 0.8 weight percent, generally 1.2 to about 3 weight percent or more donatable hydrogen, based on the weight of the diluent, and (2) non-hydrogen donor diluents which contain less than 0.8 weight percent donatable hydrogen, based on the weight of the diluent. When a hydrogen donor diluent is used, it may be any of the known hydrogen donor diluents. The hydrogen donor diluent employed will typically be an intermediate stream boiling between 350° F. (176.67° C.) and about 800° F. (426.67° C.), preferably between about 400° F. (204.44° C.) and about 700° F. (371.11° C.) derived from a coal liquefaction process. This stream comprises hydrogenated aromatics, naphthenic hydrocarbons, phenolic materials and similar compounds and will normally contain at least 30 weight percent, preferably at least 50 weight percent, of compounds which are known to be hydrogen donors under the temperature and pressure conditions employed in the liquefaction zone. Other hydrogen-rich diluents may be used instead of or in addition to such coal derived liquids, particularly on initial startup of the process. Suitable aromatic hydrogen donor diluents include hydrogenated creosote oil, hydrogenated intermediate product streams from catalytic cracking of petroleum feedstocks, and other coal-derived liquids which are rich in indane, $C_{10}$ to $C_{12}$ tetralins, decalins, hydrogenated methylnaphthalene, hydrogenated dimethyl naphthalene, hydrogenated $C_{12}$ and $C_{13}$ acenaphthenes, and similar donor compounds. Preferably, the diluent is a hydrogen donor diluent.

Suitable ratios of hydrogen donor diluent to coal include a diluent to coal weight ratio ranging from about 0.8:1 to 4:1, preferably from about 1:1 to 2:1.

The non-hydrogen donor diluent may be a heavy hydrocarbonaceous oil or a light hydrocarbonaceous compound or mixture of compounds having an atmospheric pressure boiling point ranging from about 350° F. to about 850° F. (176.67° to 454.44° C.), preferably, ranging from about 350° F. to about 650° F. (176.67° to 343.33° C.).

Suitable heavy hydrocarbonaceous oils include heavy mineral oils; whole or topped petroleum crude oils, including heavy crude oils; asphaltenes, residual oils, such as petroleum atmospheric tower residua (boiling above about 650° F., i.e. 343.33° C.) and petroleum vacuum distillation tower residua (vacuum residua boiling above about 1,050° F., i.e. 565.56° C.); tars, bitumens; tar sand oils; shale oils, etc.

Suitable light non-hydrogen donor diluents include aromatic compounds such as alkylbenzenes, alkylnaphthalenes, alkylated polycyclic aromatics, heteroaromatics and mixtures thereof and streams such as unhydrogenated creosote oil, intermediate product streams from catalytic cracking of petroleum feedstocks, coal derived liquids, shale oil and the like.

A suitable coal slurry is pretreated, in the absence of an added extraneous catalyst, with a hydrogen sulfide-containing gas. The gas may be substantially pure hydrogen sulfide or a gaseous mixture comprising hydrogen sulfide. When a gaseous mixture is used, preferably the gaseous mixture also comprises hydrogen. Suitable concentrations of hydrogen sulfide in the hydrogen-containing gas ranges from about 1 to about 99 mole percent, preferably from about 2 to about 50 mole percent, and more preferably from about 3 to about 30 mole percent. Suitable hydrogen sulfide-containing gases include refinery process off gases comprising light hydrocarbons, recycle hydrogen streams containing $H_2S$, e.g. from coal liquefaction processes.

Suitable pretreatment conditions include a temperature ranging from about 100° to about 482° C., preferably from about 150° to about 466° C., more preferably from about 343° to about 438° C., and a pressure ranging from atmospheric to about 5000 psig, preferably from about 100 psig to about 3000 psig, more preferably from about 100 psig to about 2000 psig. The feed is pretreated for a time period ranging from about 30 seconds to about 2 hours, preferably from about 2 minutes to 1 hour, more preferably from about 5 minutes to about 30 minutes.

The resulting treated product effluent is subsequently subjected to a coal liquefaction step. Prior to the coal liquefaction step, the effluent may be separated into gaseous and liquid phases and, if desired, at least a portion of the gaseous phase containing hydrogen sulfide may be recycled to the pretreatment zone. Preferably, substantially all of the hydrogen sulfide is removed from the treated effluent prior to subjecting it to the coal liquefaction step. At least a portion of the pretreated effluent is introduced into a coal liquefaction zone where it is subjected to coal liquefaction conditions. Any suitable conditions which will convert coal to coal liquids may be employed. For example, suitable conditions for coal liquefaction include a temperature ranging from about 343 to 538° C. (649.4° to 1000° F.), preferably from about 416 to about 482° C. (780.8° to 899.6° F.), more preferably from about 427° to 468° C. (800° to 874.4° F.) at a pressure of at least 350 psig. Reaction time of about 5 minutes to several hours may be used, preferably from about 15 minutes to about 2 hours.

When the diluent employed is a hydrogen donor diluent and when the coal liquefaction step is conducted in the presence of added hydrogen, suitable hydrogen partial pressure may range from about 500 psig to about 5000 psig, preferably from about 1000 to about 3000 psig.

The effluent of the coal liquefaction zone comprises gases, and oil product and a solid residue. The effluent may be passed to a separation zone from which gases are removed overhead. This gas may be scrubbed by conventional methods to remove any undesired amount of hydrogen sulfide and carbon dioxide and, thereafter, it may be recycled to the coal liquefaction zone. The solids may be separated from the oil product by conventional means, for example, by settling or centrifuging, filtration, magnetic separation or electrostatic separation of the oil-solids slurry. Alternatively, the solids may be separated from the bulk of the liquid product by distillation of the lighter fractions to concentrate the solids in the heavy bottoms. If desired, at least a portion of the separated solids or solids concentrate may be recycled directly to the coal liquefaction zone or recycled to the coal liquefaction feedstock.

It has been found that the recycled solids are active in suppressing coke without employing the pretreatment step of the present invention. Therefore, after the solids are recycled, the pretreatment step may be omitted from the subsequent cycle.

The process of the present invention may be conducted either as batch or as a continuous type process.

The following examples are presented to illustrate the invention.

EXAMPLE 1

Experiments were made utilizing a 50/50 (by weight) mixture of Wyodak coal and hydrogenated creosote oil. Pretreatment conditions used were 30 minutes, 725° F. and 2000+ psig. The coal liquefaction (hydroconversion) reaction conditions used were 60 minutes, 820° F., 2000+ psig. Results of these experiments are summarized in Table I.

TABLE I $H_2S$ ACTIVATION OF INDIGENOUS METALS IN HDD [1] COAL LIQUEFACTION

50/50 Wyodak Coal/Hydrogenated Creosote Oil
Pretreat conditions, 30 min., 725° F., 2000+ psig
Reaction conditions, 60 min., 820° F., 2000+ psig

| Run No. | 154 | 190 | 196 | 189 | 218 | 225 |
|---|---|---|---|---|---|---|
| Pretreat | No | No | Yes | Yes | Yes | Yes |
| Gas | — | — | $H_2$ | $H_2$+18%$H_2S$ | $H_2$+18%$H_2S$ | $N_2$/18% $H_2S$ |
| Hydroconversion Gas | $H_2$ | $H_2$+8 · 2%$H_2S$ | $H_2$ | $H_2$ | $H_2$ +8 · 2%$H_2S$ | $H_2$ |
| Yields, Carbon in Coal Converted to, % | | | | | | |
| $CO + CO_2$ | 6.1 | 5.8 | 6.2 | 6.0 | 6.0 | 5.4 |
| $C_1-C_3$ Hydrocarbon | 6.0 | 7.1 | 5.9 | 5.4 | 9.4 | 6.4 |
| Oil | 68.5 | 74.3 | 74.9 | 82.9 | 77.8 | 76.4 |
| Coke | 19.4 | 12.9 | 13.0 | 5.7 | 6.9 | 11.6 |
| Liquid Analyses (Including Solvent) | | | | | | |
| Con. Carbon, % | 13.2 | 12.9 | 13.5 | 11.0 | 10.5 | 13.6 |
| S, % | 0.10 | 0.37 | 0.11 | 0.31 | 0.46 | 0.50 |

[1]HDD-hydrogen donor diluent

In Table I, comparison of run 190 versus 154 shows that hydrogen sulfide in the liquefaction treat gas gives some reduction in coke and increase in oil yield at the expense of making some additional $C_1$–$C_3$ gas and of obtaining a higher sulfur product. Conradson carbon residue is unaffected.

Comparison of run 196 versus runs 190 and 154 shows that a similar reduction in coke yield is obtained by hydrogen pretreatment without the increase in $C_1$–$C_3$ gas and without the increased sulfur content in the liquid product.

Comparison of run 189 versus run 190 shows that a greater reduction in coke yield is obtained by pretreating with hydrogen sulfide plus hydrogen without increased $C_1$–$C_3$ gas and with less increase in liquid sulfur content. Liquid yield is considerably higher. Also the hydrogen plus hydrogen sulfide pretreat leads to lower Conradson carbon residue in the liquid product.

Comparison of run 218 versus run 189 shows that after hydrogen plus hydrogen sulfide pretreat, the further presence of hydrogen sulfide in the liquefaction step partially negates the benefit of pretreat with increased coke and gas yields and higher sulfur in the liquid product. The Conradson carbon reduction from the hydrogen plus hydrogen sulfide pretreat is retained.

Comparison of run 225 versus 190 shows that hydrogen sulfide in pretreat without hydrogen present is effective in reducing coke and increasing liquid yield.

EXAMPLE 2

Experiments were made utilizing the solids recovered from a hydrogen donor diluent coal liquefaction process in which the feed was pretreated with a mixture of hydrogen and hydrogen sulfide. The results of these experiments are summarized in Table II.

TABLE II

EFFECT OF SULFIDED COAL RECYCLE SOLIDS ON HDD[1] COAL LIQUEFACTION (NO ADDED CATALYST) 50/50 WYODAK COAL/HYDROGENATED CREOSOTE OIL 820° F., 1 HR., 2000+ PSIG $H_2$

| Run No. | 196 | 154 | 189 | 198 | 200 |
|---|---|---|---|---|---|
| Added Solids | — | — | — | Solids from 189 | Solids from 198 |
| Pretreat | | | | | |
| Temp., ° F. | 725 | — | 725 | 725 | — |
| Time, Min. | 30 | — | 80 | 30 | — |
| Gas | $H_2$ | — | 18% $H_2S/H_2$ | 18% $H_2S/H_2$ | — |
| Treat Gas | $H_2$ | $H_2$ | $H_2$ | $H_2$ | $H_2$ |
| Yields, Mole % C to | | | | | |
| $CO + CO_2$ | 6.2 | 6.1 | 6.0 | 6.0 | 5.9 |
| $C_1-C_3$ Hydrocarbon | 5.9 | 6.0 | 5.4 | 5.2 | 5.9 |
| Oil | 74.9 | 68.5 | 82.9 | 87.0 | 81.9 |
| Coke | 13.0 | 19.4 | 5.7 | 1.8 | 6.2 |
| Liquid Analyses (incl. solvent) | | | | | |
| Con. Carbon, % | 13.53 | 13.21 | 11.03 | 9.45 | 11.9 |
| S, % | 0.11 | 0.10 | 0.31 | 0.35 | 0.11 |

[1]HDD-hydrogen donor diluent.

Comparison of run 198 versus run 189 shows that the recovered solids gave increased activity in suppressing coke and increasing liquid yield and reducing Conradson carbon of the liquid product.

Comparison of run 200 versus 189 and 154 shows that the recycled solids are active in suppressing coke without the hydrogen plus hydrogen sulfide pretreatment in the subsequent cycle.

EXAMPLE 3

Experiments similar to those of Example 1 but in which the temperature was varied were conducted with a 50/50 mixture of wet Wyodak coal and hydrogenated creosote oil. The results of these experiments are tabulated in Table III.

TABLE III

HDD[1] COAL LIQUEFACTION EFFECT OF PRETREAT TEMPERATURE WITH $H_2S/H_2$

Pretreat: 30 minutes, 18% $H_2S/H_2$ [2]
Reaction: 60 minutes, $H_2$ 2000+ psig, 820° F.
Feed: 50/50 100 mesh wet Wyodak coal/ hydrogenated creosote oil
Catalyst: None

| Run No. | 154 | 204 | 215 | 189 | 226 |
|---|---|---|---|---|---|
| Pretreat Temp., ° F. | — | 392 | 600 | 725 | 775. |
| Yields, Mole % Coal Carbon Converted to: | | | | | |
| $CO + CO_2$ | 6.1 | 6.00 | 6.00 | 6.00 | 5.34 |
| $C_1-C_3$ hydrocarbons | 6.0 | 7.98 | 6.22 | 5.38 | 6.51 |
| Oil | 68.5 | 72.01 | 77.76 | 82.92 | 82.36 |
| Coke | 19.4 | 14.01 | 10.02 | 5.70 | 5.79 |
| Conradson Carbon, % (incl. diluent) | 13.2 | 12.5 | 12.6 | 11.0 | 10.8 |

[1]HDD-hydrogen donor diluent.
[2]1500 psig initial pressure at room temperature.

What is claimed is:

1. A process for the liquefaction of coal, which comprises the steps of:
   (a) treating a slurry comprising coal and a diluent with a hydrogen sulfide-containing gas at a temperature ranging from 100° to about 482° C. and a pressure ranging from atmospheric to about 5000 psig, and
   (b) subjecting at least a portion of the resulting product effluent to coal liquefaction conditions in a coal liquefaction zone, substantially all of said hydrogen sulfide being removed from the treated product effluent prior to step (b).

2. The process of claim 1 wherein said hydrogen sulfide-containing gas of step (a) is substantially pure hydrogen sulfide.

3. The process of claim 1 wherein said hydrogen sulfide-containing gas of step (a) is a gaseous mixture comprising from about 1 to about 99 mole percent hydrogen sulfide.

4. The process of claim 3 wherein said gaseous mixture of step (a) also comprises hydrogen.

5. The process of claim 1 wherein said treatment of step (a) is conducted in the absence of added extraneous catalyst.

6. The process of claim 1 wherein said treatment of step (a) is conducted at a temperature ranging from about 150° to about 466° C.

7. The process of claim 1 wherein said treatment of step (a) is conducted at a pressure ranging from about 1000 to about 3000 psig.

8. The process of claim 1 wherein said diluent is a hydrogen donor diluent.

9. The process of claim 1 wherein said diluent is a non-hydrogen donor diluent.

10. The process of claim 1 wherein said diluent is a non-hydrogen donor heavy hydrocarbonaceous oil.

11. The process of claim 1 wherein said diluent is a hydrocarbonaceous compound or mixture of hydrocarbonaceous compounds having an atmospheric pressure boiling point ranging from about 176.67° C. to about 454.44° C.

12. The process of claim 1 wherein a hydrogen-containing gas is introduced into said coal liquefaction zone.

13. The process of claim 1 wherein said coal liquefaction conditions include a temperature ranging from about 343° to 538° C., and a total pressure ranging from about 350 to about 5000 psig.

14. The process of claim 1 wherein the effluent resulting from said coal liquefaction step (b) comprises an oil product and a solid residue and wherein at least a portion of the solid residue is separated from said effluent and at least a portion of the separated solid residue is recycled to said coal liquefaction zone.

15. The process of claim 14 wherein after said solid residue is recycled to said coal liquefaction zone, said step (a) treatment is discontinued.

16. A process for the liquefaction of coal, which comprises the steps of:
   (a) treating a slurry comprising coal and a non-hydrogen donor diluent, in the absence of added catalyst, with a hydrogen sulfide-containing gas at a temperature ranging from 100° to about 482° C. and a pressure ranging from atmospheric to about 5000 psig;
   (b) removing substantially all of said hydrogen sulfide from the resulting treated effluent, and
   (c) subjecting at least a portion of the product resulting from step (b) to coal liquefaction conditions in the presence of hydrogen.

17. The process of claim 16 wherein said non-hydrogen donor diluent is a heavy hydrocarbonaceous oil.

18. The process of claim 16 wherein said non-hydrogen donor diluent is a hydrocarbonaceous compound or a mixture of hydrocarbonaceous compounds having an atmospheric pressure boiling point ranging from about 176.67° to about 454.44° C.

* * * * *